US007117918B2

(12) United States Patent
Franssen

(10) Patent No.: US 7,117,918 B2
(45) Date of Patent: Oct. 10, 2006

(54) MOUNTING DEVICE FOR A GUIDE CORD

(75) Inventor: Johannes Robertus Maria Franssen, EC Breda (NL)

(73) Assignee: Hunter Douglas Industries BV, El Rotterdam (NL)

( * ) Notice: Subject to any disclaimer, the term of this patent is extended or adjusted under 35 U.S.C. 154(b) by 0 days.

(21) Appl. No.: 10/971,214

(22) Filed: Oct. 22, 2004

(65) Prior Publication Data

US 2005/0087311 A1 Apr. 28, 2005

(30) Foreign Application Priority Data

Oct. 24, 2003 (EP) ..... 03078360

(51) Int. Cl.
*A47H 1/00* (2006.01)

(52) U.S. Cl. ..... 160/84.06; 160/172 R

(58) Field of Classification Search ..... 160/172 R, 160/173 R, 178.1 R, 84.06, 279; 24/136, 24/115 F, 115 M See application file for complete search history.

(56) References Cited

U.S. PATENT DOCUMENTS 2,570,455 A * 10/1951 Junkunc ..... 160/178.1 R
2,574,609 A * 11/1951 Appelbaum ..... 160/178.1 R
2,662,261 A * 12/1953 Mikoski ..... 24/528
4,776,381 A * 10/1988 Riddiford ..... 160/172 R
4,909,298 A * 3/1990 Langhart et al. ..... 160/178.1 R
5,533,559 A * 7/1996 Judkins ..... 160/84.06
5,918,656 A * 7/1999 Daniels et al. ..... 160/168.1 R
6,796,360 B1 * 9/2004 Ferrie et al. ..... 160/172 R

FOREIGN PATENT DOCUMENTS

| | | |
|---|---|---|
| DE | 2 133 731 | 1/1973 |
| DE | 93 17 094 U | 1/1994 |
| DE | 195 45 316 A1 | 6/1997 |
| GB | 871557 | 6/1961 |
| GB | 1007045 | 10/1965 |

* cited by examiner

*Primary Examiner*—David M. Purol
(74) *Attorney, Agent, or Firm*—Dorsey & Whitney LLP

(57) ABSTRACT

A two-part mounting device for attaching a free end of a guide cord of a window covering to a window frame. The device includes a base that can be secured to the frame and a holder which can be attached to the free end of the cord. The holder and the free end of the guide cord can be moved, relative to the base, in opposite directions, by sliding the holder in either one of the opposite directions while the holder and base remain engaged. The holder and base can also be disengaged by sliding the holder in one of the opposite directions. The device also includes a ratchet and pawl mechanism.

20 Claims, 2 Drawing Sheets

MOUNTING DEVICE FOR A GUIDE CORD

CROSS REFERENCE TO RELATED APPLICATION

This application claims priority to European patent application No. 03078360.9, filed Oct. 24, 2003, which is hereby incorporated by reference as if fully disclosed herein.

BACKGROUND OF THE INVENTION

1. Field of the Invention

This invention relates to a mounting device for a guide cord for a cord-guided covering, such as a roller blind, pleated blind or venetian blind or a combination of such blinds, for an architectural opening, such a vertical or a slanted window (e.g., a roof window). More particularly, this invention relates to a mounting device for a covering that provide adjustability for the distance between parallel running guide cords mounted within a frame of such an architectural opening.

2. Description of the Relevant Art

Cord-guided blinds usually include a plurality of guide cords and their ends generally run parallel to one another. Mounting devices for such guide cords are therefore also mounted parallel to each other and a predetermined distance from each other. Two-part mounting devices are generally preferred with a base that is fixed to a wall, window frame or the like and a cooperating holder, to which a cord end is attached. Generally, the cord holders of these mounting devices are easy to attach and detach from their bases.

Such two-part mounting devices are known from GB 871,557 and GB 1,007,045. In these devices, the base (5,9) is an angle bracket, fixed to a wall or window frame and includes a slot (4,14), running laterally inward and perpendicular to the wall or window frame for engaging the cord holder. The cord holder is a steel disk with a central hole for the end of the guide cord and a boss or collar for snapping into a widened area of the slot. The slot contains several widened areas, thus allowing the position of the end of the guide cord to be adjusted relative to a window by moving the holder to a widened area closer or further away from the window. The relative positions of the widened areas are meant to make the angle bracket suitable for different window constructions, to which a covering is to be mounted.

The bases of the mounting devices of GB 871,557 and GB 1,007,045 are intended to be attached to a wall adjacent a window, and the devices allow the lateral distance between the parallel ends of guide cords and the wall to be adjusted. However, the devices do not allow the longitudinal distances between the parallel ends of guide cords to be adjusted. Such longitudinal adjustability would be desirable, so that small mistakes (e.g., from measurement mistakes or improperly drilling a hole in a surface to adhere the base of the mounting device to the surface) can be corrected. If the longitudinal distance between the parallel ends of guide cords of a blind is too wide or too narrow, this can cause extra wear and tear on the blind material and interfere with the proper operation of the blind. Thus, it is desirable to be able to adjust as easily as possible the longitudinal distance between the parallel ends of guide cords.

Yet another drawback of the mounting devices of GB 871,557 and GB 1,007,045 is that they can only hold the end of a single guide cord. In blinds such as pleated blinds, it is often necessary to attach several guide cords ends to a single mounting device.

SUMMARY OF THE INVENTION

In accordance with this invention, a two-part mounting device is provided for attaching a free end of a guide cord of a cord-guided covering for an architectural opening to a fixed surface, wherein the device includes a base that can be secured to the fixed surface and a holder which can be attached to the free end of the cord; the holder being adapted for slidable and releasable engagement with the base, so that when the base is secured to the fixed surface: i) the holder and the free end of the guide cord can be moved, relative to the base, in opposite directions along the fixed surface by sliding the holder in the opposite directions while the holder and base remain in engagement and ii) the holder and base can be disengaged by sliding the holder in one of the opposite directions.

BRIEF DESCRIPTION OF THE DRAWINGS

Further aspects of the invention will be apparent from the detailed description below of a particular embodiment and the drawings thereof, in which.

DETAILED DESCRIPTION OF THE PREFERRED EMBODIMENTS

Figure 1:
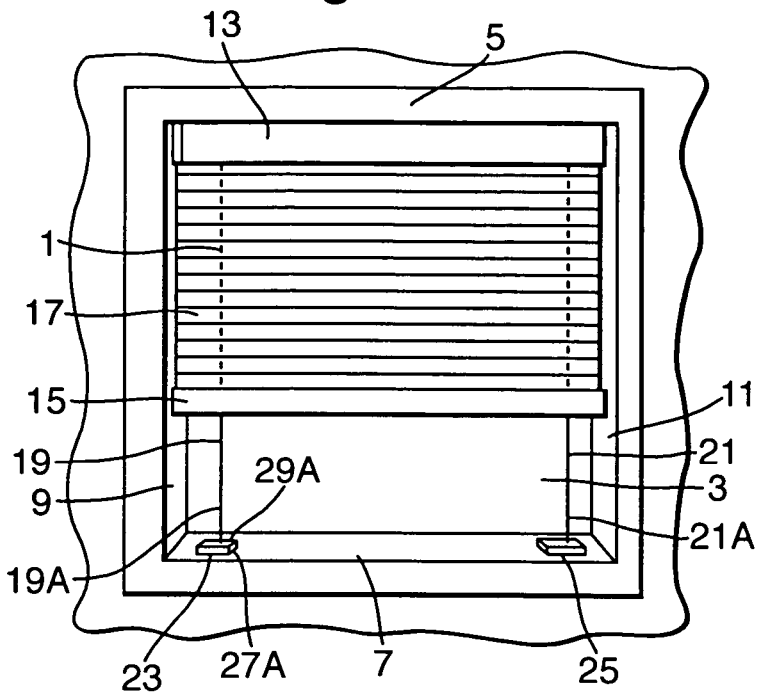
FIG. 1 is a schematic perspective view of a cord-guided covering for a window, with end parts of guide cords of the covering mounted, by means of the two-part mounting device of the invention, on a fixed surface extending laterally from the window.

FIG. 1 shows a generally conventional, cord-guided, pleated blind 1, mounted in a window 3. The window 3 is framed by longitudinally- and laterally-extending, top and bottom, fixed surfaces 5, 7 and by vertically- and laterally-extending, left and right, fixed surfaces 9, 11. The blind 1 is attached to the top fixed surface 5 by a longitudinally-extending head rail 13. The blind has a longitudinally-extending bottom rail 15 and a blind material 17 extending between the head rail 13 and the bottom rail 15. Left and right, guide cords 19, 21 extend from the head rail 13, through the blind material 17 and the bottom rail 15, to the bottom surface 7. Parallel bottom ends 19A, 21A of the left and right guide cords 19, 21 are attached to left and right, mounting devices 23, 25 of the invention which are secured to the bottom surface 7. The mounting devices 23, 25 allow the position of the parallel bottom ends 19A, 21A of the guide cords 19, 21 to be adjusted in a longitudinal direction, so that the bottom ends 19A, 21A can be moved longitudinally towards or away from each other.

The left and right cord mounting device 23, 25 are identical and comprise mirror images in Figures. Thus, the following description of the left mounting device 23 is fully applicable to the right mounting device 25.

Figure 2:
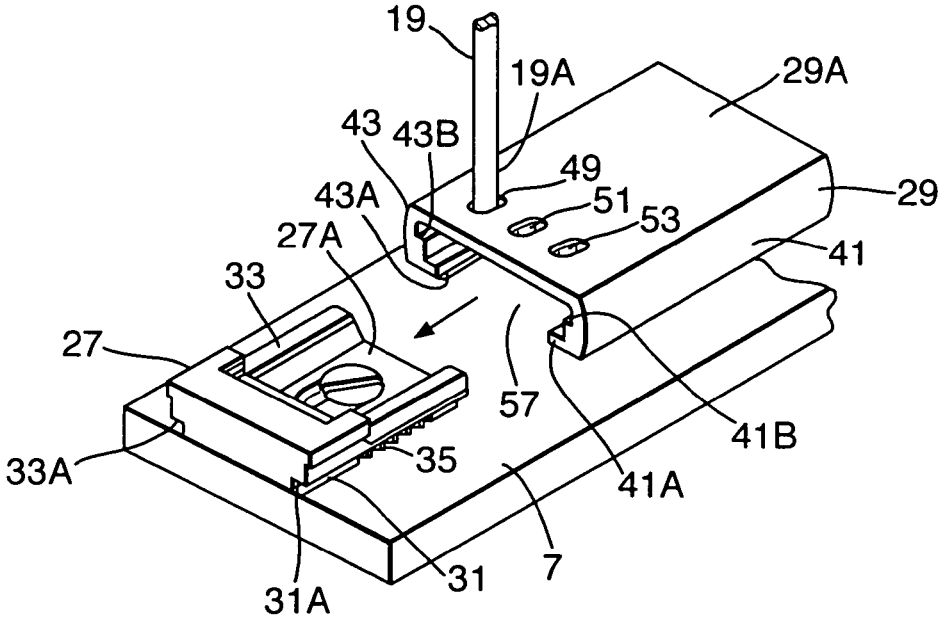
FIG. 2 is a perspective view of the two-part mounting device of FIG. 1, where the two parts are not yet engaged with one another.
Figure 3:
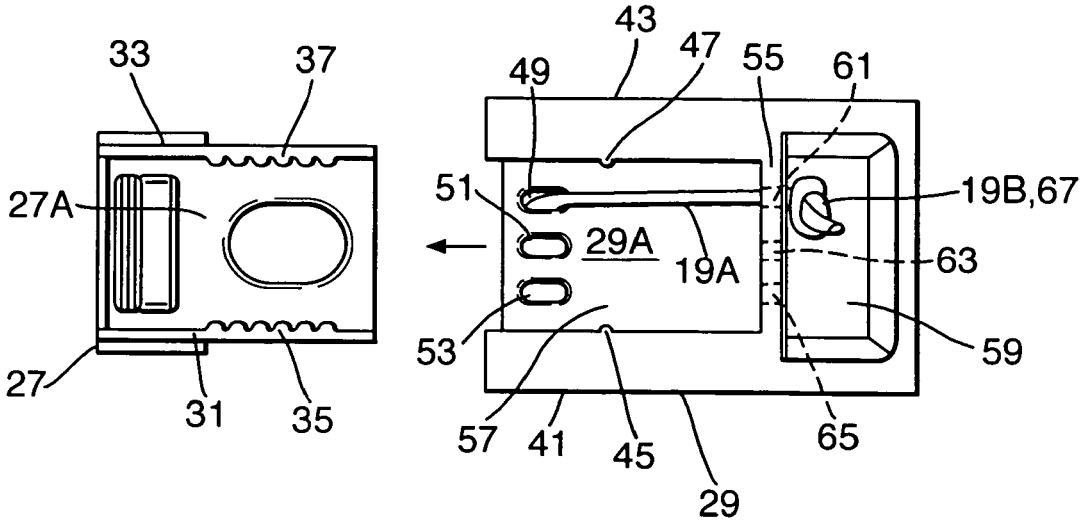
FIG. 3 is a bottom view of the two-part mounting device of FIG. 1 where the two parts are in not yet engaged with one another.
Figure 4:
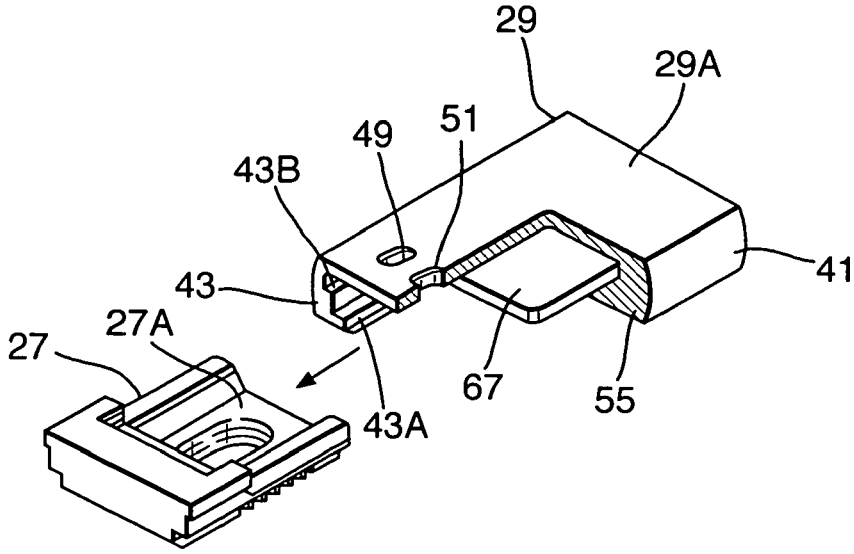
FIG. 4 is a perspective view, partially in cross-section, of the mounting device of FIG. 1, including a magnetic plate, where the two parts are not yet engaged with one another.

As shown in FIGS. 2–4, the left mounting device 23 has a base 27 and a cord holder 29 that slidably cooperate with each other. As shown in FIGS. 1 and 2, the base 27 is secured to the bottom surface 7 of the frame of the window 3, so that the holder 29 engages the base 27 by sliding longitudinally to the left along and atop the base, toward the left surface 9 of the frame of the window. As the holder 29 is slid further longitudinally to the left along and atop the base 27, toward the left surface 9 of the window frame, increasingly more of the holder engages and overlies the base.

The base 27 of the left mounting device 23 has a flat, horizontally-extending, bottom web 27A, which is fixed to the bottom surface 7 of the window frame. The base 27 also has longitudinally-extending, front and rear walls 31, 33 that extend upwardly from the bottom web 27A and laterally apart from the bottom web and each other. As a result, the bottom of the base walls 31, 33 have front and rear, longitudinally-extending, undercut portions 31A, 33A, respectively, adjacent the bottom web 27A.

The holder 29 of the left mounting device 23 has a flat, horizontally-extending, top web 29A which overlies the bottom web 27A of the base 27 in the mounting device 23 as shown in FIG. 1. The holder 29 also has longitudinally-extending, front and rear walls 41, 43 that extend downwardly from the top web 29A and extend laterally towards each other and towards the top web. As a result, the bottom of the holder walls 41, 43 have rear and front, longitudinally-extending, bottom shoulder portions 41A, 43A, respectively, that are remote from the top web 29A and that extend laterally towards each other. The facing rear and front surfaces of the front and rear, holder walls 41, 43 slidingly cooperate respectively with the adjacent, front and rear surfaces of the front and rear base walls 31, 33 when assembling the left mounting device 23 by sliding the holder 29 longitudinally to the left along and atop the base 27, toward the left surface 9 of the window frame. In this regard, the bottom shoulder portions 41A, 43A of the holder walls 41,43 slide beneath, and engage, the undercut portions 31A, 33A of the base walls 31, 33 when assembling the mounting device 23. This engagement keeps the holder 29 from thereafter being pulled vertically from the base 27 of the assembled mounting device 23 (for example, by a vertically-directed pulling force on the left guide cord 19, attached to the device).

The longitudinally-extending, front and rear, surfaces of the base walls 31, 33 of the left mounting device 23 also have front and rear, longitudinally-extending toothed portions 35, 37, respectively, above their undercut portions 31A, 33A. The toothed ratchet portions 35, 37 are formed by parallel vertically-extending indentations in the front and rear surfaces of the base walls 31, 33. The longitudinally-extending, rear and front surfaces of the holder walls 41, 43 of the mounting device 23 also have a pair of laterally-extending pawls 45, 47. The pawls 45, 47 are adapted to interact in a conventional manner with the toothed ratchet portions 35, 37 of the base 27 to provide a ratchet and pawl mechanism which allows the holder 29 to be slidably moved and then held in different longitudinal positions relative to the base 29 while the base and holder remain engaged with, and attached to, one another. In this regard, the engagement of the toothed ratchet portions 35, 37 of the base 27 with the pawls 45, 47, respectively, of the holder 29 prevents the holder form being inadvertently displaced longitudinally relative to the base.

The bottom web 27A of the base 27 is preferably generally rectangular. One or more vertically-extending holes 33 are provided in the bottom web 27A. Thereby, the bottom web can be readily affixed to bottom surface 7 of the window frame by conventional means, such as with a screw 47 extending through the hole 33 and the bottom web 27A into the bottom surface 7 of the window frame.

As shown in FIG. 2, the top web 29A of the holder 29 also is preferably generally rectangular. The top web 29A is provided with one or more, preferably a plurality, of vertically-extending holes 49, 51, 53, through which the bottom end 19A of the left guide cord 19 can be inserted into the left mounting device 23. The plurality of top web holes 49, 51, 53 preferably are laterally-aligned in the top web 29A.

As shown in FIG. 3, an intermediate wall 55 extends downwardly from the bottom surface of the top web 29A of the holder 29, between its longitudinal ends. The intermediate wall 55 is perpendicular to the holder walls 41, 43 and extends laterally between them. As a result, the intermediate wall 55 forms left and right, partially-enclosed spaces or chambers 57, 59 within the holder 29. The intermediate wall 55 also is provided with one or more, preferably a plurality of, longitudinally-extending holes 61, 63, 65, through which the bottom end 19A of the left guide cord 19 can be inserted further into the left mounting device 23. The plurality of intermediate wall holes 61, 63, 65 preferably are laterally aligned in the intermediate wall 55.

In FIGS. 2 and 3, the end 19A of the left guide cord 19 is shown as being inserted through the rear-most hole 49 of the top web 29A of the holder 29 into its left space 57, then longitudinally through the rear-most hole 61 in its intermediate wall 55 and then into its right space 59. A knot 67 is provided on the portion 19B of the left guide cord end 19A within the right space 59 of the holder 29 in order to hold the left guide cord portion 19B within the right space 59 and thereby hold the left guide cord end 19A on the holder. Thus, the holder 29, with the end 19A of the left guide cord 19 attached thereto, can then be slid longitudinally to the left, toward the left surface 9 of the window frame, into engagement with the base 27 and then slid further longitudinally along and atop the base 27 to assemble the left mounting device 23. When the left guide cord 19 is then pulled taut (e.g., by a cord tensioner), the knot 67 will abut against the intermediate wall 55, and the ratchet mechanism, formed by the engaged toothed portions 35, 37 of the base 27 and the pawls 45, 47 of the holder 29, will keep the tension in the left guide cord 19 from causing the holder to move longitudinally along the base. However, the ratchet mechanism will allow the user of the blind 1 to move the holder 29 longitudinally to the left or right between adjacent toothed portions 35, 37 of the base 27 without the holder becoming disengaged from the base.

As shown in FIG. 4, the mounting device 23 can carry a magnetic plate 67. The plate 67 provides a locking action between the mounting device and metal on the bottom rail 15 to prevent the blind 1 from opening inadvertently. For this purpose, either the plate 67 is a magnet and the bottom rail 15 includes a material that is attracted to the magnet or the plate is a material that can attract a magnet and a magnet is incorporated in the bottom rail. The plate 67 is preferably located directly beneath the bottom surface of the top web 29A of the holder 29 and to the right of the top web holes 49, 51, 53. The front and rear walls 41, 43 of the holder 29 have rear and front, longitudinally-extending, intermediate shoulder portions 41B, 43B that extend laterally towards each other between the bottom shoulder portions 41A, 43A and the top web 29A. The plate 67 rests on the intermediate shoulder portions 41B, 43B and abuts against the left surface of the intermediate wall 55. The left guide cord 19, when connected to the holder 29, preferably passes beneath the plate 67 in going from the top web holes 49, 51, 53 to the intermediate wall holes 61, 63, 65.

This invention is, of course, not limited to the above-described embodiment which may be modified without departing from the scope of the invention or sacrificing all of its advantages. In this regard, the terms in the foregoing description and the following claims, such as "vertical", "longitudinal", "lateral", "perpendicular", "upwardly", "downwardly", "inner", "outer", "right", "left", "front", "rear", "top", "bottom", "upper" and "lower", have been used only as relative terms to describe the relationships of the various elements of the two-part mounting device for a cord-guided window covering of the invention as shown in the Figures. For example, the blind 1 could also be a venetian blind with guide cords perpendicular to the horizontal slats for guiding the slats when the blind is opened or closed.

I claim:

1. The combination of a fixed frame member around an architectural opening and a cord-guided covering mounted in said architectural opening, said covering including a two-part mounting device for attaching an end of a guide cord of said covering to said fixed frame member wherein the device includes a base secured to said fixed frame member and a holder attached to the end of the cord; the holder being adapted for slidable and releasable engagement with the base, so that: (i) the holder and the free end of the guide cord can be moved, relative to the base, in opposite directions along the fixed frame member by sliding the holder in opposite directions while the holder and base remain in engagement and (ii) the holder and base can be disengaged by sliding the holder in one of the opposite directions; and wherein said device also includes a ratchet and pawl mechanism, wherein a toothed ratchet portion is located on one of the base or the holder and a pawl is located on the other of the base or the holder for cooperation with the toothed ratchet portion.

2. The combination of claim 1 wherein said opposite directions are longitudinal and the top of the holder has a plurality of vertically-extending laterally-aligned holes, through which the end of the guide cord can be inserted into the device.

3. The combination of claim 2 wherein a laterally-extending intermediate wall extends downwardly from the top of the holder between its longitudinal ends and thereby forms left and right, partially-enclosed spaces within the holder; the intermediate wall has one or more, longitudinally-extending holes, through which the end of the guide cord can be inserted further into the mounting device.

4. The combination of claim 3 wherein the intermediate wall has a plurality of said longitudinally-extending holes which are laterally aligned in the intermediate wall.

5. The combination of claim 1 wherein the opposite directions are longitudinal and the top of the holder has a plurality of vertically-extending laterally-aligned holes, through which the end of the guide cord can be inserted into the device.

6. The combination of claim 5 wherein a laterally-extending intermediate wall extends downwardly from the top of the holder between its longitudinal ends and thereby forms left and right, partially-enclosed spaces within the holder; the intermediate wall has one or more, longitudinally-extending holes, through which the end of the guide cord can be inserted further into the mounting device.

7. The combination of claim 6 wherein the intermediate wall has a plurality of said longitudinally-extending holes which are laterally aligned in the intermediate wall.

8. The combination of claim 1 wherein a laterally-extending intermediate wall extends downwardly from the top of the holder between its longitudinal ends and thereby forms left and right, partially-enclosed spaces within the holder; the intermediate wall has one or more, longitudinally-extending holes, through which the end of the guide cord can be inserted further into the mounting device.

9. The combination of claim 8 wherein the intermediate wall has a plurality of the longitudinally-extending holes which are laterally aligned in the intermediate wall.

10. The combination of any of the claims 1 or 2–9 wherein a plate that is a magnet or a material which can attract a magnet is beneath the top of the holder.

11. A two-part mounting device for attaching an end of a guide cord of a cord-guided covering for an architectural opening to a fixed surface wherein the device includes a base that can be secured to the fixed surface and a holder which can be attached to the free end of the cord; the holder being adapted for slidable and releasable engagement with the base, so that when the base is secured to the fixed surface: i) the holder and the free end of the guide cord can be moved, relative to the base, in opposite directions along the fixed surface by sliding the holder in the opposite directions while the holder and base remain in engagement and ii) the holder and base can be disengaged by sliding the holder in one of the opposite directions and which also includes a ratchet and pawl mechanism, wherein a toothed ratchet portion is located on one of the base or the holder and a pawi is located on the other of the base or the holder for cooperation with the teethed ratchet portion.

12. The device of claim 11 wherein the opposite directions are longitudinal and the top of the holder has a plurality of vertically-extending laterally-aligned holes, through which the end of the guide cord can be inserted into the device.

13. The device of claim 12 wherein a laterally-extending intermediate wall extends downwardly from the top of the holder between its longitudinal ends and thereby forms left and right, partially-enclosed spaces within the holder; the intermediate wall has one or more, longitudinally-extending holes, through which the end of the guide cord can be inserted further into the mounting device.

14. The device of claim 13 wherein the intermediate wall has a plurality of the longitudinally-extending holes which are laterally aligned in the intermediate wall.

15. The device of claim 11 wherein the opposite directions are longitudinal and the top of the holder has a plurality of vertically-extending laterally-aligned holes, through which the end of the guide cord can be inserted into the device.

16. The device of claim 15 wherein a laterally-extending intermediate wall extends downwardly from the top of the holder between its longitudinal ends and thereby forms left and right, partially-enclosed spaces within the holder; the intermediate wall has one or more, longitudinally-extending holes, through which the end of the guide cord can be inserted further into the mounting device.

17. The device of claim 16 wherein the intermediate wall has a plurality of the longitudinally-extending holes which are laterally aligned in the intermediate wall.

18. The device of claim 11 wherein a laterally-extending intermediate wall extends downwardly from the top of the holder between its longitudinal ends and thereby forms left and right, partially-enclosed spaces within the holder; the intermediate wall has one or more, longitudinally-extending holes, through which the end of the guide cord can be inserted further into the mounting device.

19. The device of claim 18 wherein the intermediate wall has a plurality of the longitudinally-extending holes which are laterally aligned in the intermediate wail.

20. The device of any of the claims 11–19 wherein a plate that is a magnet or a material which can attract a magnet is beneath the top of the holder.

* * * * *